United States Patent [19]

Nonini

[11] Patent Number: 4,749,025

[45] Date of Patent: Jun. 7, 1988

[54] CONTINUOUS CASTING LINE WITH MULTIPLE FUNCTION STIRRERS

[75] Inventor: Geremia Nonini, Buttrio, Italy

[73] Assignee: Danieli & C. Officine Meccaniche SpA, Buttrio, Italy

[21] Appl. No.: 836,741

[22] Filed: Mar. 6, 1988

Related U.S. Application Data

[63] Continuation of Ser. No. 681,582, Dec. 14, 1984, abandoned.

[30] Foreign Application Priority Data

Sep. 17, 1984 [IT] Italy ..... 83416 A/84

[51] Int. Cl.[4] ..... B22D 27/02

[52] U.S. Cl. ..... 164/468; 164/478; 164/416; 164/504

[58] Field of Search ..... 164/468, 504, 147.1, 164/499, 443, 485, 478, 416, 418, 348, 128

[56] References Cited

U.S. PATENT DOCUMENTS

| | | | |
|---|---|---|---|
| 2,963,758 | 12/1960 | Pestel et al. | 164/468 X |
| 4,375,830 | 3/1983 | Rohrig | 164/468 |
| 4,480,678 | 11/1984 | Cazaux et al. | 164/416 |

FOREIGN PATENT DOCUMENTS

| | | | |
|---|---|---|---|
| 229759 | 2/1969 | U.S.S.R. | 164/468 |

*Primary Examiner*—Koang Y. Lin

*Attorney, Agent, or Firm*—Wegner & Bretschneider

[57] ABSTRACT

Continuous casting line (10) comprising ingot mould means (11) having any required inclination ranging from 0° to 90°, oscillation means (17) and a roller conveyor (12) with at least one curved segment, and which includes at least one electromagnetic source (25) that acts with a variable effect.

8 Claims, 3 Drawing Sheets

CONTINUOUS CASTING LINE WITH MULTIPLE FUNCTION STIRRERS

This application is a continuation of Ser. No. 681,582, filed Dec. 14, 1984, and now abandoned.

This invention concerns a continuous casting line with multiple-function stirrers. To be more exact, this invention concerns a continuous casting line which has any required development and provides for the use of multiple-function stirrer means.

The overall lay-out of the ingot mould and casting line is contained within any desired arc comprised between 0° and 90°.

The invention can therefore be applied to horizontal, almost horizontal, vertical or almost vertical castings. In fact, the innovative principles of the invention can be obtained with any type of casting ranging from the horizontal to the vertical. In the following description, while disclosing an application to an almost horizontal casting, it is to be understood that the subject of the invention can be applied to any continuous casting.

The known art has attempted to provide embodiments intended to reduce the overall bulk of continuous casting lines. As is known, traditional continuous casting lines include a vertical or substantially vertical ingot mould and a casting line which curves progressively until it takes up a substantially horizontal development in correspondence with an extraction and straightener unit.

In such embodiments, as the curvature of the casting line cannot of necessity increase beyond a given limit, the casting line, including the ingot mould, has a considerable vertical bulk.

Embodiments to reduce such considerable vertical bulk have been proposed which are intended to arrange the casting line with a substantially oblique development.

For instance, Swiss Pat. No. 403172 claims a device for the continuous casting of metals together with the employment of an ingot mould shaped with an arc of a circle and also a curved guide for bars located downstream and an extraction means, the device being characterized by an arrangement of the ingot mould below a horizontal plane passing through the center of curvature of the ingot mould; in this case a plane running through such center of curvature and through the upper edge of the inner wall of the curved ingot mould forms together with the above horizontal plane an angle of between 20° and 89°.

Such patent also claims the application of an electromagnetic device to affect the direction of the casting.

This proposal, however, is subject to natural limitations regarding the practical embodiment of the invention and the inability of the electromagnetic device to affect the casting actively without leading to anomalies within such casting.

All known electromagnetic devices in general involve these shortcomings although they have entailed progress too as compared to the preceding art.

Firstly, the main problem arising with such solutions is the lack of uniformity in the cooling of the molten metal introduced into the ingot mould.

Such lack of uniformity can lead to cracks and flaws within the material and in any event may make the casting and extraction of the bars difficult besides lowering the quality of the material.

Moreover, the inclination of the free surface of the casting in relation to the walls of the ingot mould entails difficulties regarding the departure of any gases trapped within the molten metal. Such gases therefore stay within the ingot mould and remain enclosed in the bar when the metal solidifies.

Thus the castings which can be obtained in this way are not free of flaws and it is extremely hard, if not actually impossible, to produce a material having optimum properties.

In the cited patent the attempt to save space in the overall bulk of the ingot mould and casting line in a vertical direction is nullified by the very great overall vertical bulk of the casting line/stirrer means assemblage.

It is a purpose of the present invention to overcome the drawbacks linked to the known art by providing a continuous casting line which meets the necessary requirements of a minimum bulk and also offers excellent conditions for cooling the molten material inside the ingot mould.

It is also a purpose of this invention to obtain an optimum drawing-stirring effect in line with the requirements of a perfect casting and solidification of the cast material.

According to the invention an electromagnetic source having one or more sections is provided and cooperates with the ingot mould and/or secondary casting line (the segment downstream of the ingot mould).

Such electromagnetic source exerts a pendular action according to the invention, and this action can be obtained in various ways.

A first way is linked to a mechanical oscillation device which bears and takes the electromagnetic source forwards and backwards.

In horizontal casting operations or with straight ingot moulds such pendular device can be embodied, for instance, with a parallelogram system.

A second way is linked to a mechanical device which bears one or more electromagnetic sources and sets them in continuous rotation in cooperation with the ingot mould. Such mechanical device can be a wheel or an endless catenary with a rotary ring.

A third method is linked to an electrical device which induces with a required progression the succession of the actuation of the various sections forming the electromagnetic source, which in this case remains stationary.

According to the invention the electromagnetic source can act in the same direction as the feed of the casting but can act also in the opposite direction.

Thus, for example, it may act with the maximum possible intensity in the direction of feed whereas in the opposite direction it may act with a lesser intensity able to maintain a given turbulence perhaps in the opposite direction (inversion of polarity).

Again, according to the invention the electromagnetic action can be varied in intensity during the path of the casting and be adapted to the actual ability of the bath to accept such action.

Moreover, according to the invention the electromagnetic action can undergo one or more inversions of polarity in localized zones or along the path of the casting.

If the electromagnetic source is stationary and is actuated electrically or electronically, it can be immersed in a cooling chamber.

Such cooling chamber can be independent or be a part of the cooling chamber of the ingot mould.

In such an embodiment the cooling fluid is introduced into a rear annular chamber near the outlet of the bar and passes into a reduced interspace outside the ingot mould; the interspace can be embodied with a section differentiated on its various sides.

In this way different flows are obtained on the various sides, and there is therefore differentiated cooling that accompanies the electromagnetic action.

In another embodiment the interspace may comprise several chambers. For instance, two chambers may be provided, a lower and an upper chamber, or else four separate chambers may be provided, one on each side.

With either of such embodiments the invention, as said earlier, makes possible a controlled, differentiated cooling of the various walls of the ingot mould.

It is therefore possible to determine such cooling so as to obtain an auxiliary action to compensate the electromagnetic action, thus obtaining a bar having the required properties.

The ingot mould will be connected to oscillation means embodied according to the invention and having a modest overall bulk.

With such a lay-out it is possible to reduce the overall bulk to such an extent that the whole casting line can be pre-assembled at least partly in the factory and be transported in this form to its installation site. On arrival there the casting line of the invention will be installed without any special operations to assemble the various components, the line being merely positioned on its pre-arranged supports.

By means of the invention it is possible to obtain the required homogeneity of the product; elimination of any non-metallic inclusions and gas is facilitated.

This invention is therefore embodied with a continuous casting line comprising ingot mould means having any required inclination ranging from 0° to 90°, oscillation means and a roller conveyor with at least one curved segment, the casting line being characterized in that it comprises at least one electromagnetic source that acts with a variable effect.

We shall describe hereinafter some preferred embodiments of the invention, as non-restrictive examples, with the help of the attached figures, in which.

FIGS. *3a*, *3b* and *3c* show possible forms of the cooling interspace; and

Figure 4:
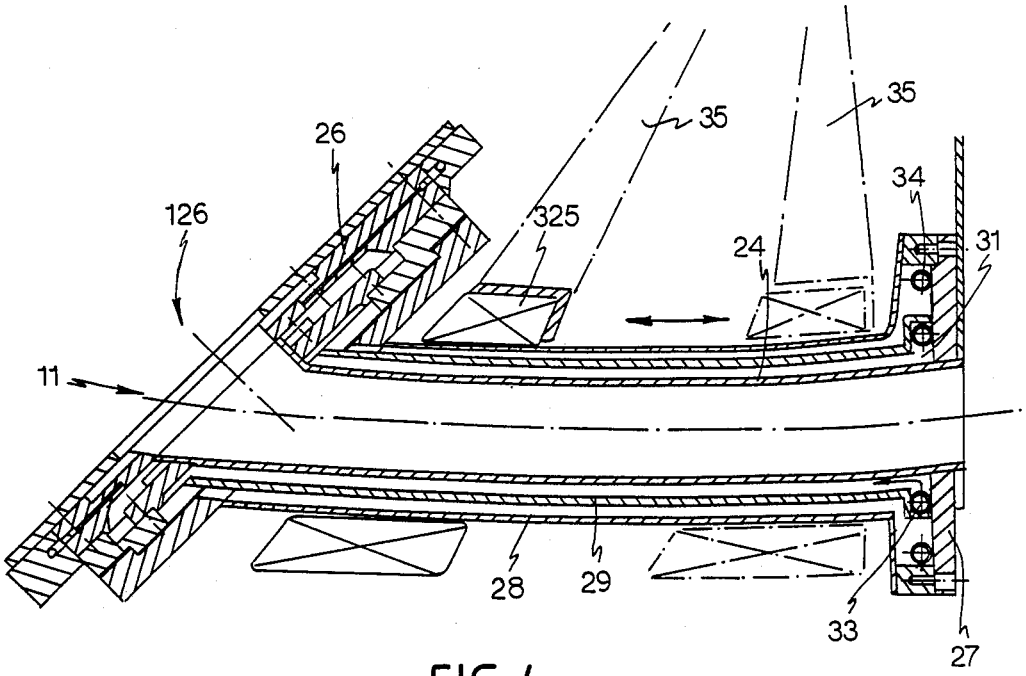

FIG. 4 shows a variant of the invention.

FIGS. *5a* and *5b* show variants of the electromagnetic source.

Figure 3A:
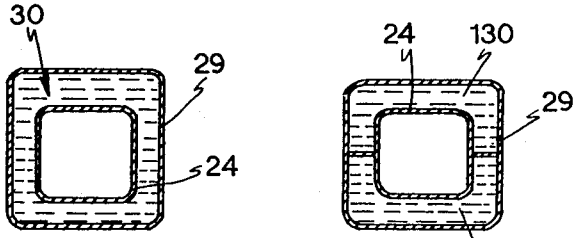
Figure 3B:
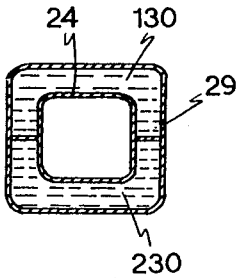
Figure 3C:
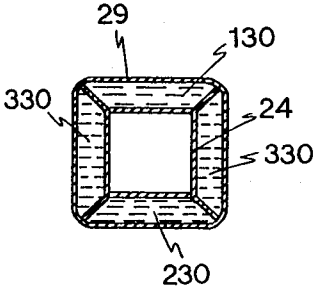
Figure 1:
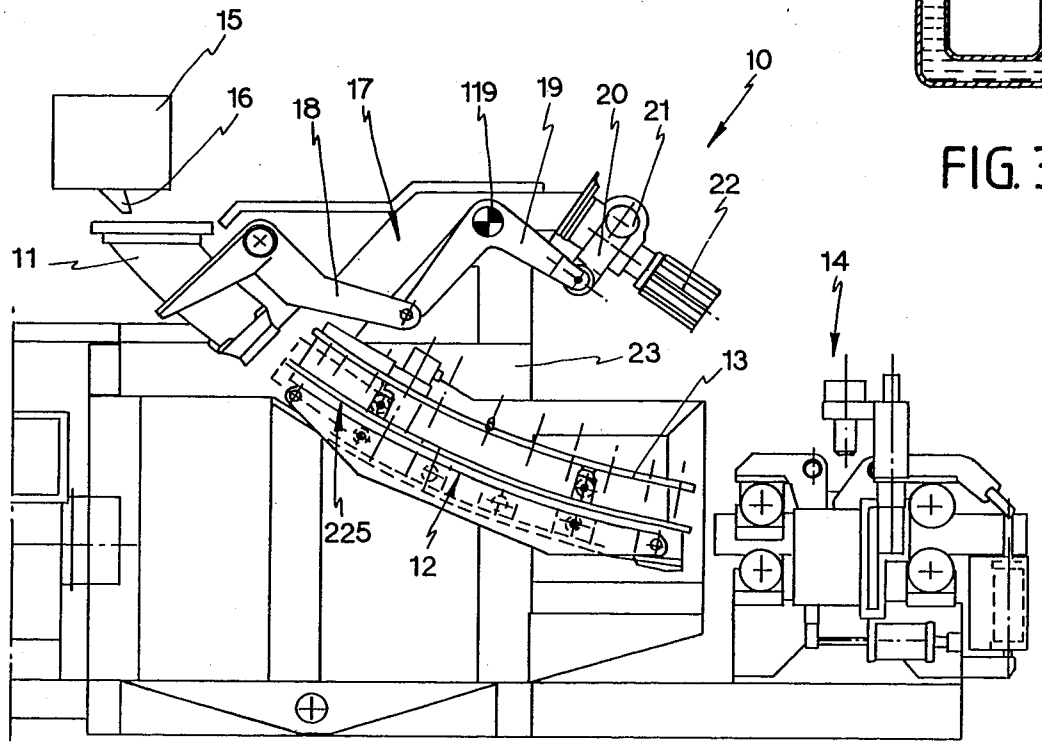
FIG. 1 shows a casting line according to the invention.

In the embodiment of FIG. 1 a casting line 10 comprises a curved ingot mould 11 shown at the left and positioned obliquely.

A roller conveyor 12, which is also curved, is located immediately downstream of the ingot mould 11 together with cooling sprayers 13.

The end segment of the roller conveyor 12 leads to an extraction and straightener unit 14.

A tundish 15 with a nozzle 16 having an oblique outlet axis is shown above the ingot mould 11.

The ingot mould 11 is borne on a fork-shaped support 18, which in its turn is solidly fixed to a rocker lever 19, which is conformed with an elbow and is pivoted at 119.

The shape of the rocker lever 19 is such that it does not protrude substantially above the level determined by its pivot 119.

In this way the overall height of the casting line 10 is considerably less than the overall height of the known embodiments and in particular is lower than the level at which the tundish 15 lies.

Thus sheds which are not particularly high can be employed and the casting line can be transported already complete and pre-assembled to its installation site.

A crank 20 is pivoted at the end of the rocker lever 19 and is driven by an eccentric 21, which in turn gets its motion through a transmission of a known type from motor means 22, which in this case comprise an electric motor. Such motor means are positioned in such a way that they do not protrude above the level cited above.

The whole assemblage of the rocker lever 19 and motor means 22 is borne by a support structure 23 having the form of a framework.

As we said earlier, such structure 23 can be supplied already assembled with all the parts fitted to it, such as the ingot mould 11 on its support 18, the rocker lever 19 already fitted rotatably at 119 and the motor 22 with the crank 20.

Likewise the curved roller conveyor 12 to extract the bars can already be assembled on the bearing structure 23 in the factory.

In view of its modest overall size, the whole can be transported as it is to its installation site.

Figure 2:
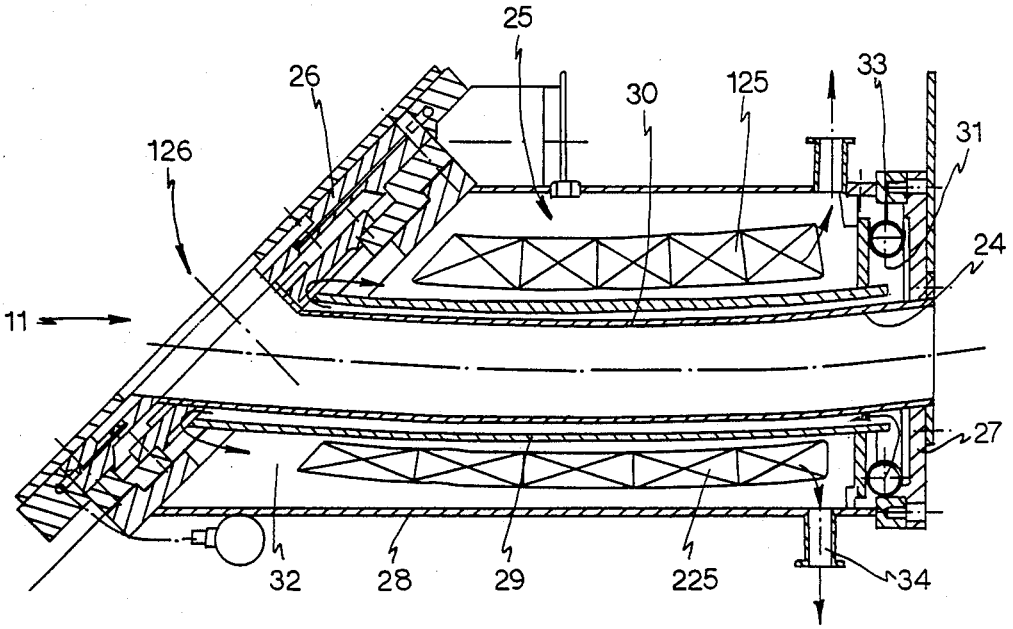
FIG. 2 shows a side view of an ingot mould according to the invention.

FIG. 2 shows a detail of the ingot mould 11, which is illustrated cutaway in a side view.

According to this embodiment a cooling system differentiated on the various faces of the ingot mould 11 is proposed.

A lower chamber bears the reference 31 and surrounds the lower opening of the ingot mould 11. The cooling fluid is delivered to this chamber 31 by means of conduits 33 for the introduction of fluid.

Such fluid is distributed from the chamber 31 into an interspace 30 located between a wall 24 of the ingot mould 11 and an intermediate wall 29.

The cooling fluid thus enters the interspace 30 on the outside of the ingot mould 11.

According to the invention the interspace 30 can be conformed in various manners so as to provide a differentiated cooling of the ingot mould 11.

FIG. *3a* shows an embodiment in which the interspace 30 has a differentiated section.

In this way a differentiated distribution of the flow of cooling liquid is obtained along the upper wall, lower wall and side walls respectively of the ingot mould 11.

FIG. *3b* shows an embodiment in which the interspace 30 is formed with an upper chamber 130 and lower chamber 230 respectively. Such chambers 130–230 may have the same section or different sections.

If their section is the same, the feed of fluid may be divided; for instance, it is possible to divide the chamber 31 (see FIG. 1) into two portions, of which one communicates with the interspace 130 and the other with the interspace 230.

Correspondingly there will be separate feeds of fluid to the two parts of the chamber 31.

FIG. *3c* shows an embodiment with four independent interspaces, namely an upper 130, a lower 230 and side interspaces 330. One or more of such interspaces may have an independent feed of fluid.

It is possible to apply differentiated sections to the interspaces 130–230–330 according to the speeds of fluid which are to be obtained and according to the pre-set flow rates.

An outer chamber 32 (FIG. 2) is located outside the intermediate wall 29 and can be pre-arranged for the application of electromagnetic stirrer means 25, coils 125 of which are shown diagrammatically. In this case five coils 125 are provided on one side and five coils 225 on the other side of the ingot mould 11.

The number of coils 125–225 can be varied to suit the requirements, but experiments have shown that three will be the minimum number, whereas the maximum number will depend on factors of functioning and economical working.

The orientation of the coils 125–225 can be pre-set so as to create a magnetic flow of the desired direction within the ingot mould with a view to obtaining the required currents of flow within the fluid metal.

Thus the coils 125–225 may take up an annular or toric form which enfolds the ingot mould, or they may take up an L-shaped or C-shaped form so as to enfold at least two or three sides of the ingot mould 11.

In the example of FIG. 2 the coils 125–225 are located next to each other; each of them affects one side of the ingot mould, while the whole assemblage of them covers two to four side of the ingot mould 11.

In the example of FIG. 2 the coils 125–225 may have their axis parallel or normal to the ingot mould 11.

According to the invention the electromagnetic source 25 may also affect a part or the whole of the zone downstream from the ingot mould 11 to the start of the extractor bar or as far as the shears.

Suitable position for the electromagnetic source 25 downstream from the ingot mold 11 is shown by the dashed line in FIG. 1.

In this variant the source 25 can work also in the segment downstream of the ingot mould 11 or only in the segment downstream of the ingot mould 11.

Moreover, in the segment downstream of the ingot mould 11 the source 25 can be structured or pendular or rotary, with a mechanical or electrical or electronic functioning.

Figure 5A:
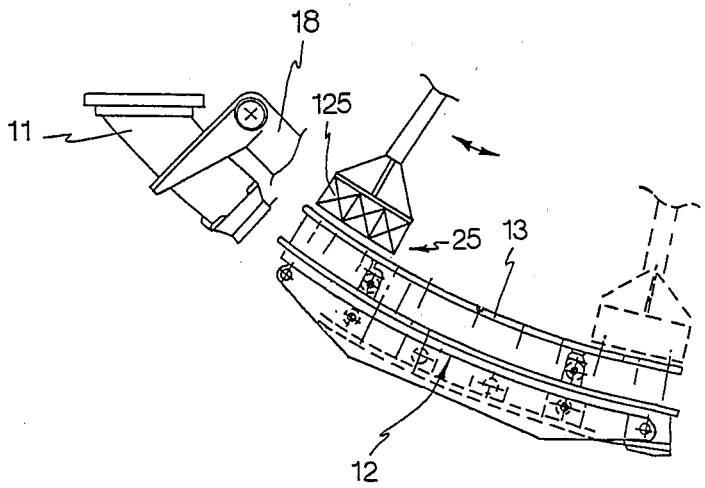
Figure 5B:
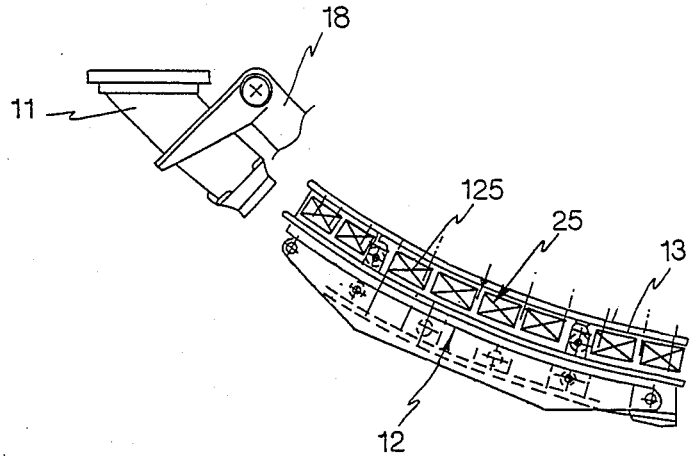

In FIG. 5*a*, the electromagnetic source 25 comprises a coil 325 movable along the casting line 12 downstream from the ingot mold 11. Coil 325 is supported by a pendular arm or the like. In FIG. 5*b*, electromagnetic source 25 comprises a plurality of coils 125 arranged by the side of the casting line 12. Coils 125 can be activated in a programmed or programmable sequence so as to achieve the desired effect.

Therefore, the variants and embodiments provided by the invention for the application of the source 25 to the ingot mould 11 can also be extended to the case where the electromagnetic source 25 cooperates with the segment downstream of the ingot mould 11 or cooperates also with the segment downstream of the ingot mould 11.

Application of the electromagnetic source 25, as we said earlier, serves to make uniform the structure of the departing ingot.

Whenever the electromagnetic source 25 is provided to cooperate with the ingot mould 11, this situation can take place according to an embodiment the same as or like that of FIG. 2. In such a case the cooling fluid reaches the chamber 32 after having passed through the interspace 30.

In this way the cooling fluid cools the electromagnetic source 25 too in the formulation employed.

Lastly, the cooling fluid leaves the chamber 32 through outlets 34 for fluid.

The special cooling system employed obtains a cooling of the ingot mould 11 which can be pre-established as required, this being a thing which cannot be obtained with traditional embodiments.

The reference number 26 indicates an upper plate where there is located a charging mouth 126 of the ingot mould 11 through which the casting of molten metal is poured.

The lower chamber 31 is shut at its rear by a rear closure 27 consisting of a plate of a substantially circular shape.

It should be noted that according to the invention the application of electromagnetic stirrer means 25 does not increase the overall bulk since such means 25 are located together with the relative coils 125–225 within the chamber 32 without creating any further external bulk.

The embodiments employed, therefore, enable a great uniformity of material leaving the ingot mould 11 to be obtained, this being impossible to obtain with known casting lines.

Instead, in this case the advantage of a particularly modest overall bulk is obtained by means of the invention.

A second advantage arising from the application of electromagnetic stirrer means within the chamber 32 in combination with the special cooling system employed consists in the uniformity of the cast bar, whereas such uniformity cannot be obtained with the traditional embodiments.

In this way the stirring and the creation of flow currents within the molten metal cause the molten metal to be made homogeneous before becoming solidified and also facilitate the elimination of any inclusions.

Instead of the set of coils 125 and/or 225 of FIG. 2, or analogous coils, actuated during casting according to a required sequence and with the methods and intensity required by the type of effect to be obtained, as we said earlier, the electromagnetic source 25 can be moved mechanically in a required manner.

Thus, for example, in FIG. 2 the components 125 and/or 225 of the electromagnetic source 25 will be actuated in sequence by electrical or electronic actuation, whereas in FIG. 4 a pendular movement will be obtained mechanically by hanging the coil 325 or a set of replacement coils from, or causing the same to be supported by, an arm 35 pivoted as required so as to obtain the desired pendular motion.

Such coil 325 or set of constituent coils is actuated either only in the direction of the running molten metal or else in the reverse direction.

If it is actuated also in the reverse direction, it can be actuated with the same methods as for the direction of running of the molten metal, or by prior inversion of the polarity, or else by reducing or at any rate varying the intensity of the field generated.

We have described here a preferred embodiment of this invention and a variant of the same but other variants too are possible without departing thereby from the scope of the invention.

Thus the shapes and proportions of the individual parts can be changed and it is possible to provide oscillation means 17 conformed otherwise than as shown or employing motor means 22 different from that shown.

It is also possible to provide coils 125–225–325 having any required orientation to suit the effect desired and being of a desired number and size.

These and other variants are all possible without departing thereby from the scope of this invention, which can be applied to vertical, almost vertical, horizontal or almost horizontal casting lines.

What is claimed is:

1. A continuous casting line for casting metal, comprising:

an ingot mold means having a charging mouth through which to pour the molten metal, side walls, and a rear closure plate through which the metal exits, said ingot mold means having an inclination from 0° to 90°;

an oscillating means to oscillate said ingot mold means;

a roller conveyor located immediately downstream of said rear closure plate for receiving the metal;

a plurality of electromagnetic coils which provide a stirring effect to metal in the ingot mold means, said coils being fixedly located in the side walls of said ingot mold means; and means for inducing said plurality of coils in a predetermined progression so as to provide pendular stirring of constant intensity from the charging mouth to the rear closure plate and in the opposite direction.

2. A continuous casting line as claimed in claim 1, further comprising cooling means for cooling the ingot mold means and the electromagnetic coils, said cooling means being located said side walls.

3. A continuous casting line for casting metal, comprising:

an ingot mold means having a charging mouth through which to pour the molten metal, side walls, and a rear closure plate through which the metal exits, said ingot mold means having an inclination from 0° to 90°;

an oscillating means to oscillate said ingot mold means;

a roller conveyor located immediately downstream of said rear closure plate for receiving the metal;

a plurality of electromagnetic coils which provide a stirring effect to metal in the ingot mold means, said coils being fixedly located in the side walls of said ingot mold means; and means for inducing said plurality of coils in a predetermined progression so as to provide pendular stirring at a first intensity from the charging mouth to the rear closure plate and at a second intensity in the opposite direction.

4. A continuous casting line as claimed in claim 3, further comprisng cooling means for cooling the ingot mold means and the electromagnetic coils, said cooling means being located said side walls.

5. A continuous casting line for casting metal, comprising:

an ingot mold means having a charging mouth through which to pour the molten metal, side walls, and a rear closure plate through which the metal exits, said ingot mold means having an inclination from 0° to 90°;

an oscillating means to oscillate said ingot mold means;

a roller conveyor located immediately downstream of said rear closure plate for receiving the metal;

a plurality of electromagnetic coils;

means for mechanically displacing said electromagnetic coils from the charging mouth to the rear closure plate and back again; and means for providing electromagnetic stirring at a first intensity when said means for mechanically displacing displaces the electromagnetic coils from the charging mouth to the rear closure plate, and at a second intensity when said means for mechanically displacing displaces the electromagnetic coils in the opposite direction.

6. A method of stirring metal in a continuous casting line, said continuous casting line comprising:

an ingot mold means having a charging mouth through which to pour the molten metal, side walls, and a rear closure plate through which the metal exits, said ingot mold means having an inclination from 0° to 90°;

an oscillating means to oscillate said ingot mold means;

a roller conveyor located immediately downstream of said rear closure plate for receiving the metal;

a plurality of electromagnetic coils which provide a stirring effect to metal in the ingot mold means, said coils being fixedly located in the side walls of said ingot mold means;

said method comprising inducing said plurality of coils in a pre-determined progression so as to provide pendular stirring at a first intensity from the charging mouth to the rear closure plate and at a second intensity in the opposite direction.

7. A method of stirring metal in a continuous casting line, said continuous casting line comprising:

an ingot mold means having a charging mouth through which to pour the molten metal, side walls, and a rear closure plate through which the metal exits, said ingot mold means having an inclination from 0° to 90°;

an oscillating means to oscillate said ingot mold means;

a roller conveyor located immediately downstream of said rear closure plate for receiving the metal; and a plurality of electromagnetic coils which provide a stirring effect to metal in the ingot mold means, said coils being fixedly located in the side walls of said ingot mold means;

said method comprising inducing said plurality of coils in a pre-determined progression so as to provide pendular stirring of constant intensity from the charging mouth to the rear closure plate and in the opposit direction.

8. A method of stirring metal in a continuous casting line, said continuous casting line comprising:

an ingot mold means having a charging mouth through which to pour the molten metal, side walls, and a rear closure plate through which the metal exists, said ingot mold means having an inclination from 0° to 90°;

an oscillating means to oscillate said ingot mold means;

a roller conveyor located immediately downstream of said rear closure plate for receiving the metal; and a plurality of electromagnetic coils;

said method comprising:

mechanically displacing said electromagnetic coils from the charging mouth to the rear closure plate and back again;

providing electromagnetic stirring at a first intensity when the electromagnetic coils are displaced from the charging mouth to the rear closure plate; and providing electromagnetic stirring at a second intensity when the electromagnetic coils are displaced from the rear closure plate to the charging mouth.

* * * * *